US005374225A

United States Patent [19]

Wilkinson

[11] Patent Number: 5,374,225

[45] Date of Patent: * Dec. 20, 1994

[54] RESILIENT PLATFORM EXERCISE DEVICE

[76] Inventor: William T. Wilkinson, Severnside Farm, 300 Kyle Road, Crownsville, Md. 21032-0572

[ * ] Notice: The portion of the term of this patent subsequent to May 4, 2010 has been disclaimed.

[21] Appl. No.: 208,810

[22] Filed: Mar. 9, 1994

Related U.S. Application Data

[63] Continuation of Ser. No. 986,487, Dec. 7, 1992, abandoned, which is a continuation-in-part of Ser. No. 945,373, Sep. 16, 1992, Pat. No. 5,207,622.

[51] Int. Cl.[5] ..... A63B 21/08

[52] U.S. Cl. ..... 482/27; 482/29; 482/114; 482/118; 482/74

[58] Field of Search ..... 482/114, 29, 27, 72, 482/70, 28, 124, 118, 52

[56] References Cited

U.S. PATENT DOCUMENTS

| | | | |
|---|---|---|---|
| 3,298,688 | 1/1967 | Grzybowski | 482/114 |
| 3,831,935 | 8/1974 | Hofla | 482/29 |
| 4,037,834 | 7/1977 | Oaks | 482/27 |
| 4,598,905 | 7/1986 | Vrana | 482/27 |
| 4,618,139 | 10/1986 | Haaheim | 482/70 |
| 4,723,774 | 2/1988 | Monforte | 482/72 |
| 4,743,015 | 5/1988 | Marshall | 482/114 |
| 4,804,178 | 2/1989 | Friedeback | 482/114 |
| 4,826,152 | 5/1989 | Lo | 482/114 |
| 5,007,638 | 4/1991 | Yuki | 482/28 |
| 5,074,550 | 12/1991 | Sloan | 482/29 |
| 5,207,622 | 5/1993 | Wilkinson et al. | 482/118 |

*Primary Examiner*—Richard J. Apley
*Assistant Examiner*—Jerome Donnolly
*Attorney, Agent, or Firm*—Connolly & Hutz

[57] ABSTRACT

A resilient platform exercise device includes a trampoline having a peripheral frame with a platform secured to the frame by a plurality of spaced springs for resiliently mounting the platform. An upstanding pole assembly is mounted directly to the frame juxtaposed the platform. The pole assembly terminates in two spaced handles on opposite sides of the platform in alignment with each other. Each of the handles is pivotally mounted and is movable in opposition to resistance located at the pivotal mount.

11 Claims, 4 Drawing Sheets

Fig.6.
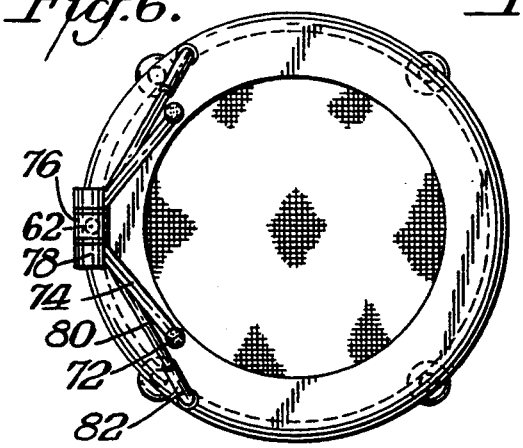
Fig.9.
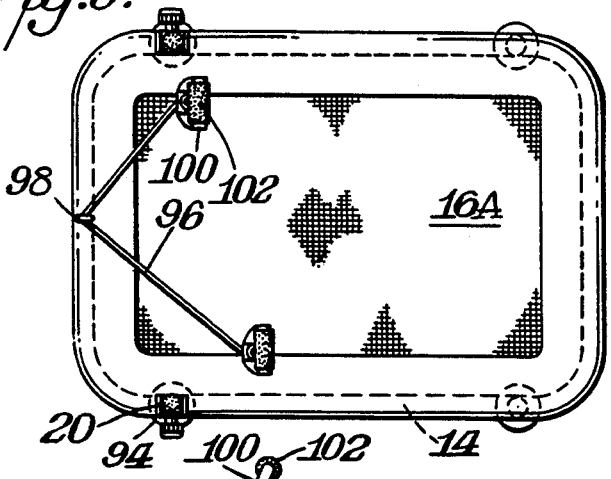
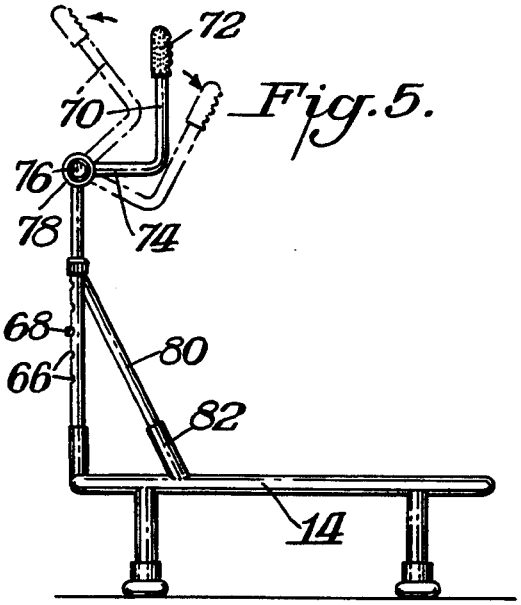
Fig.5.
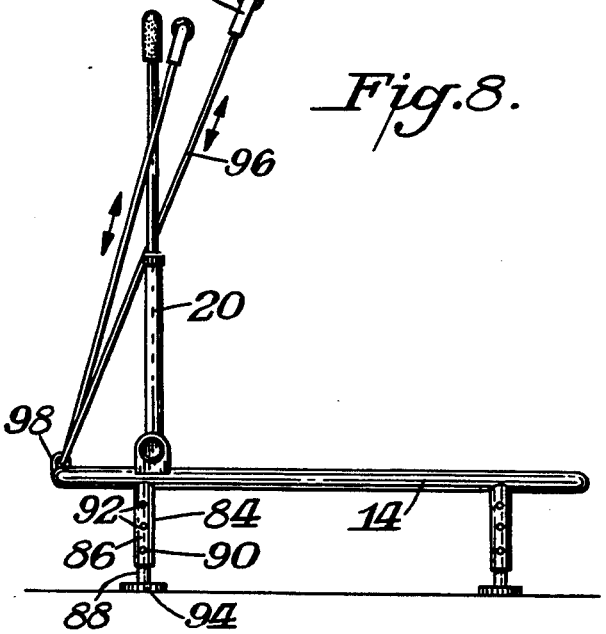
Fig.8.
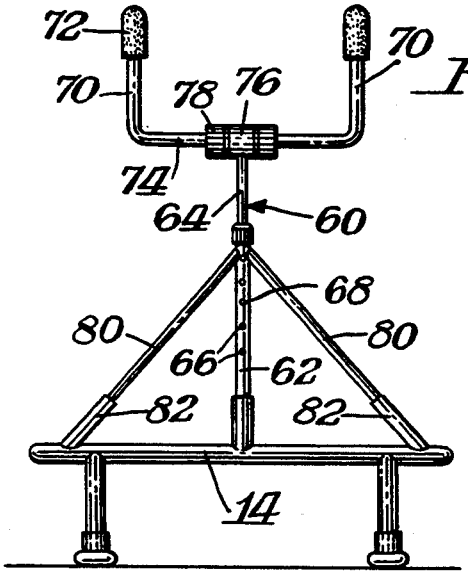
Fig.7.
Fig.10.
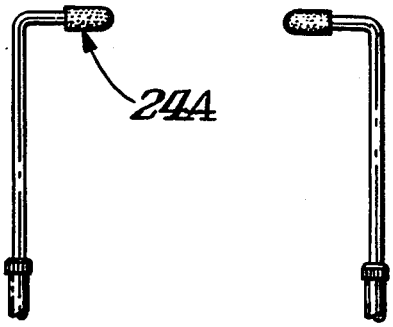

RESILIENT PLATFORM EXERCISE DEVICE

CROSS-REFERENCE TO RELATED APPLICATION

This application is a continuation of Ser. No. 07/986487 filed Dec. 7, 1992, now abandoned, which is a continuation-in-part of Ser. No. 07/945373 filed Sep. 16, 1992, now U.S. Pat. No. 5,207,622.

BACKGROUND OF THE INVENTION

Various types of exercise devices have been suggested to accomplish different aerobic programs. U.S. Pat. No. 5,074,550 describes an exercise apparatus which includes a minitrampoline having a frame with a pair of poles secured to the frame at a distance disposed away from the trampoline itself. In use, the person would exert weight on the poles in opposition to hydraulic shocks while the person is jogging or flexing on the minitrampoline.

It would be desirable if an exercise device could be provided which incorporates some of the advantages of U.S. Pat. No. 5,074,550 while providing a more versatile form of device to provide an effective upper body exercise device.

SUMMARY OF THE INVENTION

An object of this invention is to provide a resilient platform exercise device which satisfies the above needs.

A further object of this invention is to provide such a device which could be used by persons of different ages and different sizes and wherein the same device could be adjusted to accommodate each such person.

In accordance with one practice of this invention a resilient platform exercise device includes a trampoline having a peripheral frame. A platform is resiliently mounted to the frame by a plurality of spaced springs. An upstanding pole assembly is mounted directly to the frame juxtaposed the platform. The pole assembly terminates in two spaced handles above the platform with the handles being on the opposite sides of the platform in general alignment with each other. The handles are pivotally mounted with respect to the platform. Resistance means at the pivotal mounting resist the pivotal movement of each of the handles.

The pole assembly may be in the form of two separate poles, each of which is pivotally mounted directly to the frame. Alternatively, the pole assembly could be a single pole of generally Y-shape with a vertical central leg mounted to the frame and with a yoke extending from the leg. The ends of the yoke would comprise the handles. The handles would be pivotally mounted to the central leg.

The invention may also be practiced with a device which includes a spring board rather than a trampoline and which also includes the pole assembly.

THE DRAWINGS:

FIG. 5 is a side elevational view of a modified device in accordance with this invention;

FIG. 6 is a top plan view of the device shown in FIG. 5;

FIG. 7 is an end elevational view of the device shown in FIGS. 5–6;

FIG. 8 is a side elevational view of yet another embodiment of this invention;

FIG. 9 is a top plan view of the embodiment shown in FIG. 8;

FIG. 10 is an end elevational view of a modified form of handle structure, otherwise similar to the device shown in FIGS. 1–4;

DETAILED DESCRIPTION

Figure 2:
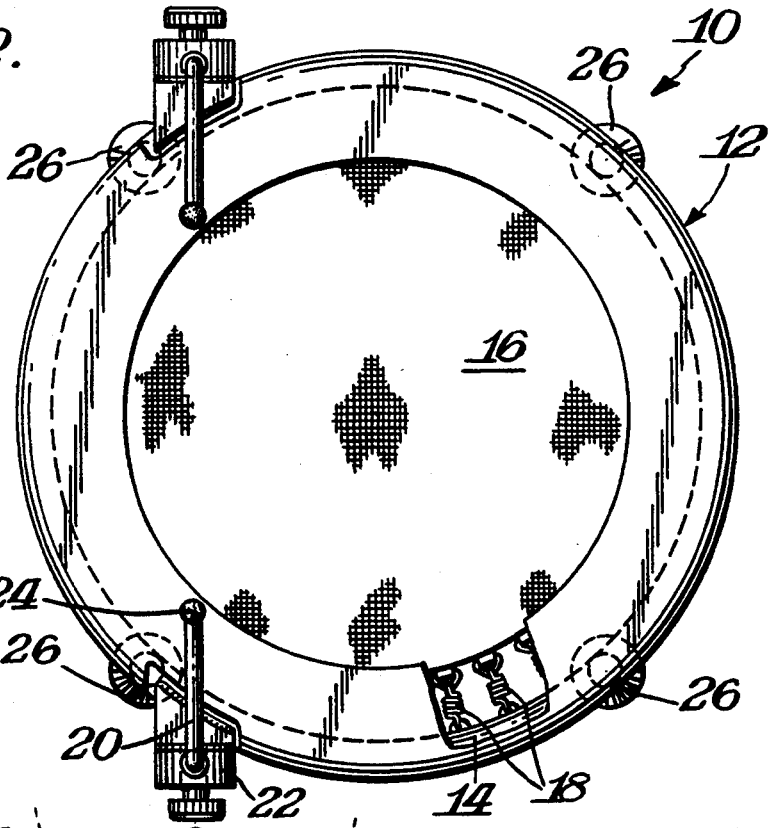
FIG. 2 is a top plan view partly broken away of the device shown in FIG. 1.

The present invention relates to a resilient platform exercise device which includes a resiliently mounted platform in the form for example of either a trampoline or a spring board. A pole assembly is mounted directly to the frame of the trampoline or spring board, juxtaposed the trampoline platform or spring board platform. The pole assembly terminates in two spaced handles above the platform. The handles are pivotally mounted to move in opposition to resistance means during use of the device.

FIGS. 1–4 show one practice of this invention wherein the device 10 utilizes a trampoline 12 as the resilient platform exercise device. Trampoline 12 may take any known suitable form. In the illustrated embodiment trampoline 12 includes a peripheral rigid frame 14 with a platform 16 resiliently connected to the frame by a plurality of spaced springs 18.

An upstanding pole assembly is mounted directly to the frame. In the embodiment of FIGS. 1–4 the pole assembly is in the form of two separate poles 20. One end of each pole 20 is mounted to frame 14 by a pivotal mounting means 22 while the opposite end of pole 20 terminates in a handle 24 disposed above the platform 16. The two handles 24 are mounted on opposite sides of platform 16 in alignment with each other thus where a circular platform 16 is used the handles 24 are in a plane which forms a chord across the circular platform.

As also illustrated, frame 14 includes a plurality of legs 26 for elevating the platform 16. In the illustrated form legs 26 are fixedly mounted to frame 14 and are of fixed height. It is to be understood, however, that the invention could be practiced where the legs 26 are adjustable as illustrated, for example, in the embodiment of FIGS. 8–9.

Figure 1:
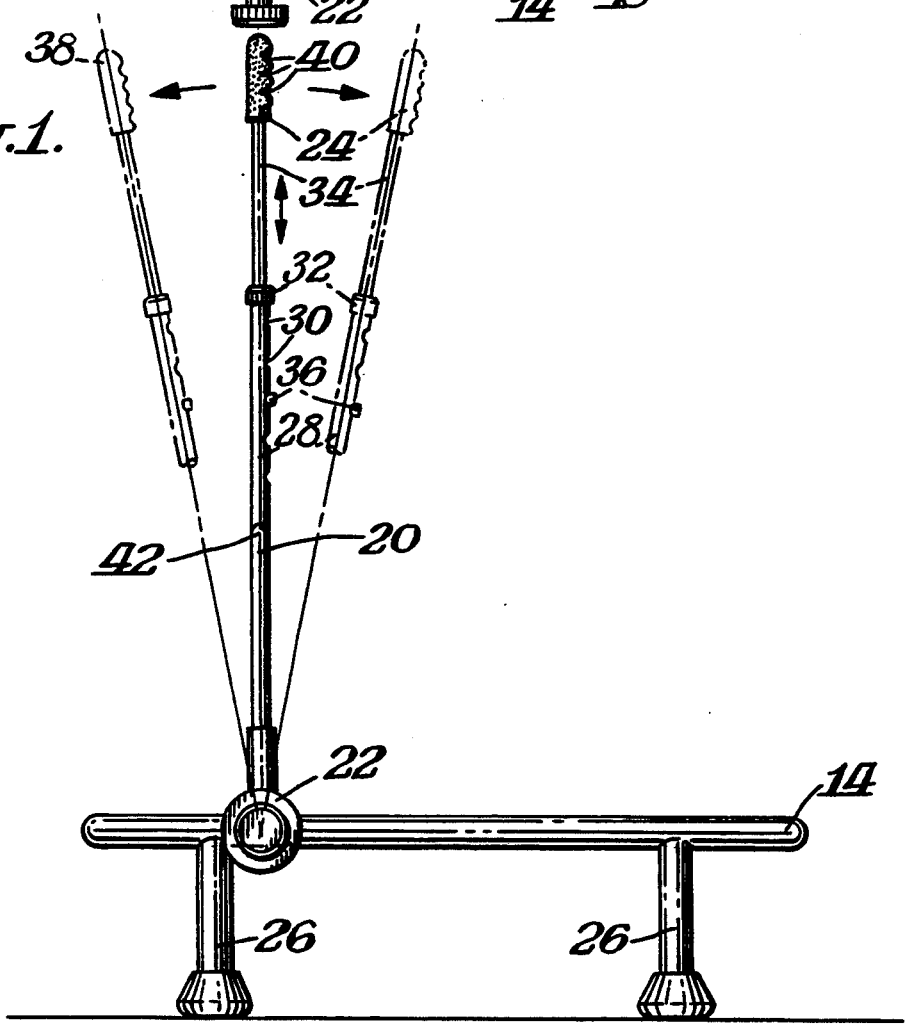
FIG. 1 is a side elevational view of a resilient platform exercise device in accordance with one embodiment of this invention.

Each pole 20 is adjustable in length. The length adjustability could be achieved in any suitable manner. In the preferred practice of this invention the length adjustability is achieved by forming each pole in a telescopic manner. Thus, as shown in FIG. 1 pole 20 includes an outer tube 28 having a series of holes 30 with a collar 32 at the end of tube 28. An inner rod 34 is telescoped into outer tube 28. Inner rod 34 has a locking member such as spring pin 36 for selective engagement with one of the holes 30 to thereby control the extent of telescoping of rod 34 in tube 28.

Holes 30 can be arranged in sets of columns around tube 28 so that the position of handles 24 can be adjusted where an inclined or bent inner member 34 is used by rotating the inner member to select the proper hole 30 for pin 36.

Handle 24 preferably includes a gripping sleeve 38 having finger indents 40. Gripping sleeve 38 may be made of any suitable material such as a rubber or foam material which could be detachably mounted on rod 34.

Figure 3:
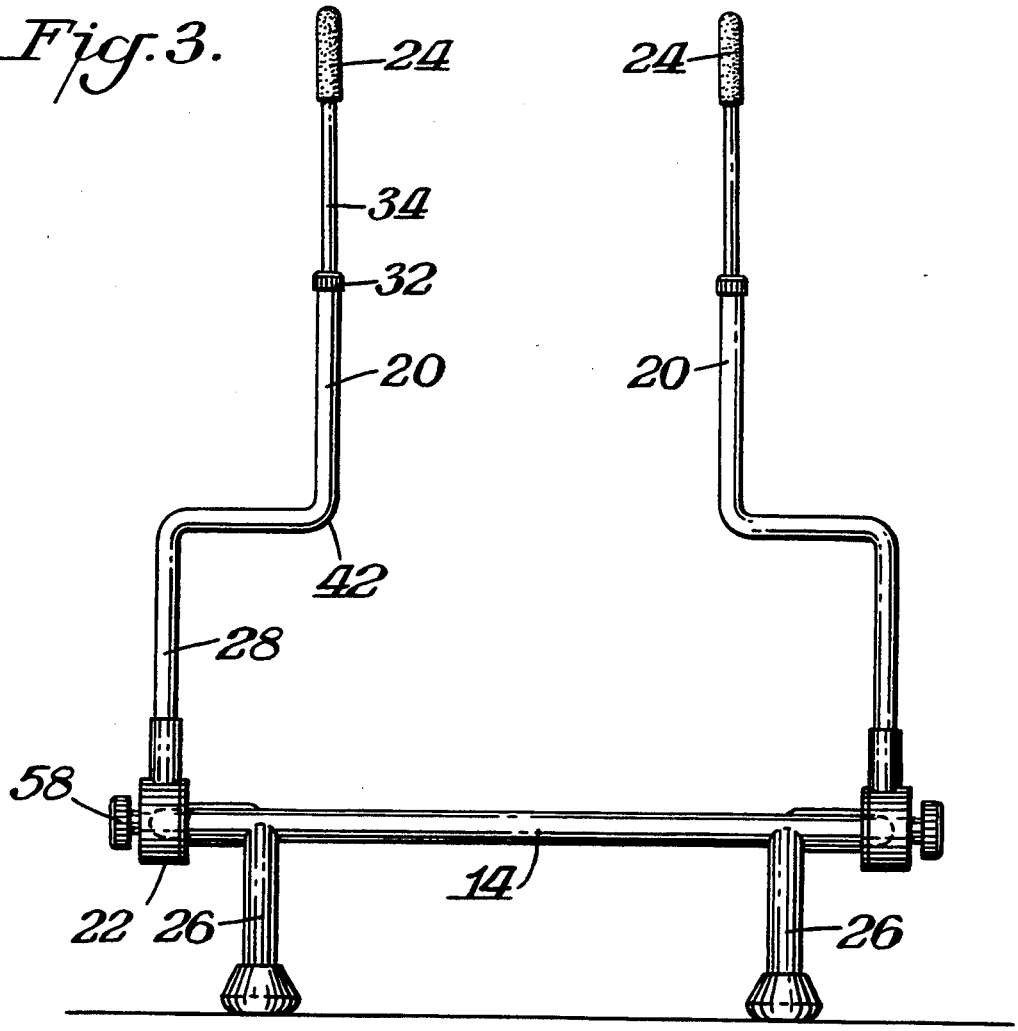
FIG. 3 is an end elevational view of the device shown in FIGS. 1–2.

As shown in FIG. 3 tube 28 includes an elbow section 42 so that the upper portion of tube 28 and the telescopically received rod 34 is offset from the location of mounting means 22. Thus, these offset portions of the poles 20 result in locating the handles directly above the platform 16.

Mounting means 22 may take any suitable form and preferably is of the general type of structure illustrated and described in co-pending application Ser. No. 07/945,373 filed Sep. 16, 1992 the details of which are incorporated herein by reference thereto. In general, mounting means 22 includes a clamp assembly 44 which is in the form of a pair of shells having outwardly extending flanges 46 with a nut 48 detachably secured to a bolt 50 extending through flanges 48 so as to tighten the shells 44 around frame 14. The upper shell includes a slot 52 through which a fastener 54 extends to permit the spacing of the upper shell 44 to vary with respect to the lower shell 45 so as to accommodate different size frames 14. This form of mounting makes each pole completely detachably mounted from the frame 14 so that the poles can be removed during periods of non-use such as in storage or transportation. Alternatively, the mounting permits the poles to be pivoted or folded downwardly into contact with the platform 16 and when the poles are adjusted to their shortest length the resultant unit is in a compact from to facilitate storage or transportability during periods of non-use.

Figure 4:
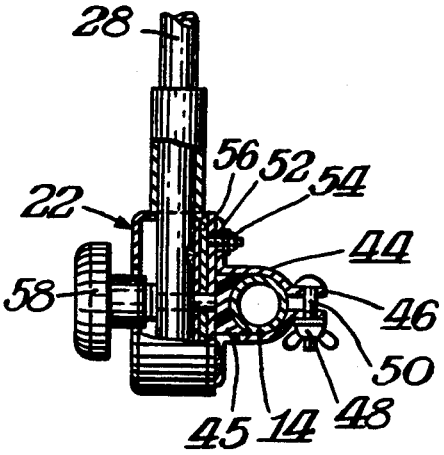
FIG. 4 is a side elevational view partly in section showing the mounting of a pole to the frame in the device shown in FIGS. 1–3.

As also shown in FIG. 4 a friction brake 56 is provided at mounting means 22 and the degree of resistance is controlled by knob 58 as described in co-pending application Ser. No. 07/945,373.

The embodiment of FIGS. 1–3 illustrates the handles 24 to be vertical members parallel to each other. FIG. 10 illustrates a modified form wherein the handles **24*a*** are turned inwardly so as to be aligned with each other in a horizontal orientation. This also results in the handles being closer together which would be desirable for some forms of exercise.

FIGS. 5–7 illustrate a modified form of pole assembly. As shown therein the pole assembly is of generally Y-shape with a central lower member 60 constructed generally along the same lines as a single pole 20 in that it includes an outer tube 62 having a telescopically receiving inner rod 64 which is adjustable in length by means of holes 66 in tube 62 which are selectively engaged by a locking pin 68 connected to rod 64. The upper portion of the Y-shaped pole assembly is in the form of a yoke which terminates in a pair of free ends to comprise the handles 70. Each individual handle 70 would be generally similar to handle 24 and would include, for example, a grip member 72. Handles 70 have horizontal extensions 74 which are pivotally connected to a cylindrical block 76 mounted on rod 64. The yoke formation disposes the handles 70 directly over the platform 16. The pivotal connection is by means of a pivotal mounting assembly 78 generally similar to mounting assembly 22 in that it includes an adjustable friction brake to oppose the pivotal movement of the handles 70 with respect to central member 60.

In order to provide stability a pair of brace members or stabilizing rods 80 is secured on opposite sides of tube 62. Each of the stabilizing rods 80,80 and tube 62 is mounted to frame 14 in any suitable manner such as being received in a reinforced sleeve 82.

FIG. 5 illustrates in solid lines and in phantom the pivotal movement that results when the user grips handles 70,70 while the central member 62 remains fixed.

FIGS. 8–9 are included to show how the platform 16A could be of a non-circular shape such as a rectangle. FIGS. 8–9 also illustrate adjustability legs 84 to be mounted to frame 14 to provide height adjustable for the platform. Legs 84 could be adjustable in any suitable manner, such as being in the form of an outer tube 86 which telescopically receives an inner rod 88 with the height being controlled by a spring pin 90 on rod 88 engaged in a selective hole 92. A foot 94 is provided at the lower end of rod 88.

FIGS. 8–9 illustrate a further feature of this invention which may also be incorporated in any of the embodiments of this invention. As shown therein a resistance cord 96 is mounted to frame 14 in any suitable manner. In the illustrated embodiment the resistance cord 96 extends through a loop or bracket 98 mounted directly to frame 14 so as to result in two individual cord sections, each of which terminates in a handle member 100 which could be of any suitable form such as having a grip element 102 made of a rubber or foam material in tubular form so that the respective ends of resistance cord 96 could be inserted through the axial opening in the grip member 102 and secured to itself to maintain the grip member mounted in place. In use the user would hold each handle 100 and stretch the resistance member in opposition to the inherent resistance imparted by the material itself. It is to be understood that other forms of resistance members, such as including spring members, could be utilized to provide the desired resistance rather than forming the cords from a resilient material.

Figure 12:
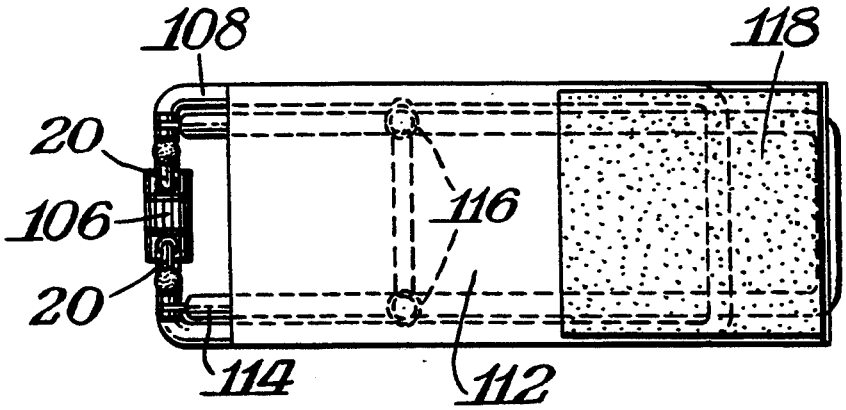
FIG. 12 is a top plan view of the embodiment shown in FIG. 11.
Figure 11:
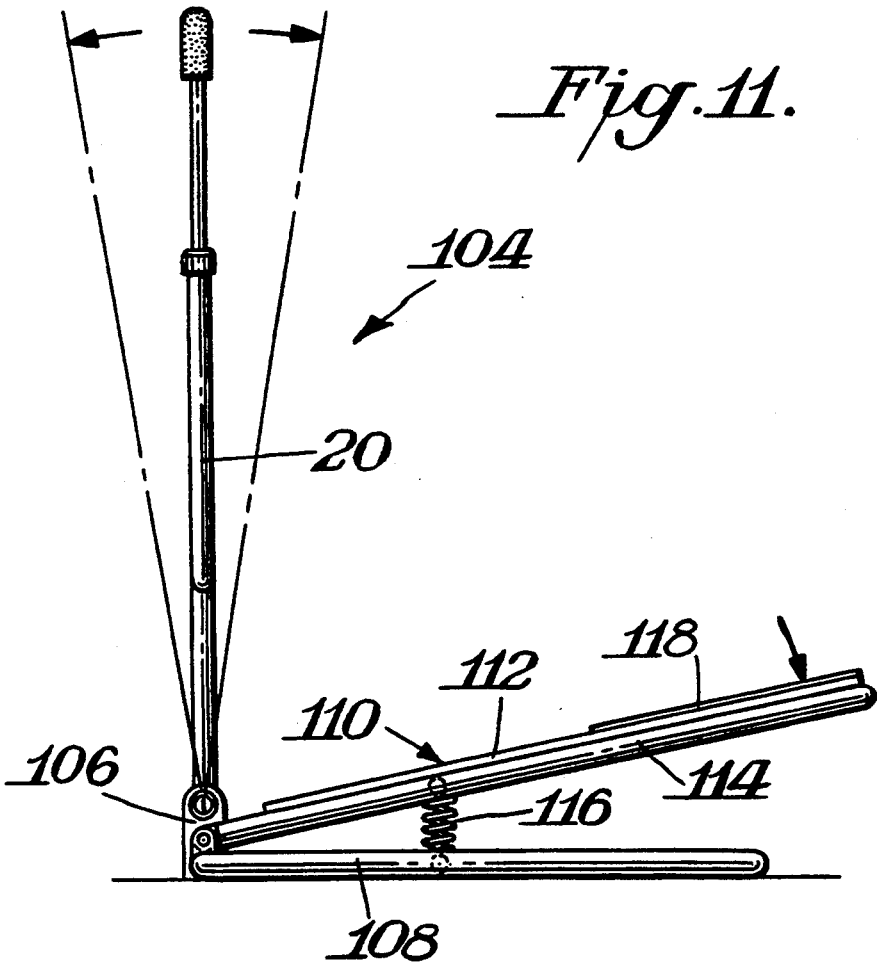
FIG. 11 is a side elevational view of yet another embodiment of this invention.

FIGS. 11–12 illustrate an alternative form of resilient platform exercise device 104 wherein the device is of a spring board type and includes pole assemblies such as poles 20 mounted directly to a flange 106 which is part of the frame 108 for spring board 110. Spring board 110 would otherwise be of any suitable known structure and would include a platform 112 mounted on a support member 114 resiliently connected by spring 116 to the base portion of frame 108. A pad 118 could be provided at the end of platform 112. It is to be understood that the spring board version of the invention could incorporate various features which have been described with respect to the trampoline version including the various forms of adjustability and the legs for elevating the spring board as well as the different form of the pole assemblies and as well as the resistance cords.

The invention accordingly provides a pole assembly in combination with a resilient platform exercise device in such as a manner as to dispose the handles at the same general location of the resilient platform itself so as to facilitate the use of the pivotally mounted handles during a resilient exercise platform program to function as an upper body exercise device.

What is claimed is:

1. A resilient platform exercise device comprising a trampoline, said trampoline including a peripheral frame, a platform, a plurality of spaced springs connecting said platform to said peripheral frame for resiliently mounting said platform to said peripheral frame, an upstanding pole assembly, mounting means mounting said pole assembly directly to said peripheral frame juxtaposed said platform, said pole assembly including two spaced handles disposed above said platform, said handles being on opposite sides of said platform in general alignment with each other, pivot means pivotally mounting each of said handles with respect to said platform, said handles having a vertical position perpendicular to said platform when said handles are aligned with each other, at least a portion of said platform being generally vertically juxtaposed and spaced below said handles when said handles are in said vertical position, and resistance means at said pivot means resisting the pivotal movement of each of said handles.

2. The device of claim 1 wherein said pole assembly is adjustably mounted to said frame to selectively vary the height of said handles above said platform.

3. The device of claim 2 wherein said pole assembly is detachably mounted to said frame.

4. The device of claim 2 wherein said pole assembly includes two poles each of which is provided with one of said mounting means, and each of said mounting means including resistance means.

5. The device of claim 2 wherein said pole assembly is mounted for being pivoted directly against said platform to facilitate the storage and transportability of said device, and said resistance means being adjustable.

6. The device of claim 1 wherein said handles are in turned toward each other to be horizontal and in alignment with each other.

7. The device of claim 1 wherein said pole assembly includes two poles each of which is provided with one of said mounting means, and each of said mounting means including resistance means.

8. The device of claim 1 wherein each of said poles includes an elbow section to offset said handles from said mounting means and dispose said handles closer together directly above said platform.

9. The device of claim 1 wherein said platform is directly between said handles.

10. The device of claim 4 wherein each of said poles includes an elbow section to offset said handles from said mounting means and dispose said handles closer together directly above said platform.

11. The device of claim 3 wherein said mounting means includes a clamp arrangement for accommodating different size frames.

* * * * *